US005546293A

United States Patent [19]

Moran, III

[11] Patent Number: 5,546,293

[45] Date of Patent: Aug. 13, 1996

[54] STROBE FOR DETECTOR

[75] Inventor: Walter J. Moran, III, Batavia, Ill.

[73] Assignee: Pittway Corporation, Chicago, Ill.

[21] Appl. No.: 457,532

[22] Filed: Jun. 1, 1995

Related U.S. Application Data

[63] Continuation of Ser. No. 65,624, May 21, 1993, Pat. No. 5,448,462.

[51] Int. Cl.[6] ..... F21V 7/12

[52] U.S. Cl. ..... 362/301; 362/298; 362/297; 362/347; 362/346

[58] Field of Search ..... 362/348, 301, 362/346, 347, 16, 278, 222, 342, 297, 302

[56] References Cited

U.S. PATENT DOCUMENTS

| | | | |
|---|---|---|---|
| 1,555,411 | 9/1925 | Godley . | |
| 1,900,551 | 3/1933 | Guth . | |
| 3,524,052 | 8/1970 | Troue . | |
| 3,997,778 | 12/1976 | Fieldstad, Jr. et al. . | |
| 4,028,542 | 6/1977 | McReynolds, Jr. . | |
| 4,174,533 | 11/1979 | Barthes et al. | 362/346 |
| 4,317,625 | 3/1982 | Van Allen | 354/145 |
| 4,499,529 | 2/1985 | Figueroa | 362/283 |
| 4,575,788 | 3/1986 | Lewin | 362/346 |
| 4,905,133 | 2/1990 | Mayer et al. | 362/346 |
| 5,249,110 | 9/1993 | Russello et al. | 362/294 |
| 5,251,115 | 10/1993 | Hillman et al. | 362/296 |
| 5,347,259 | 9/1994 | Jongewaard | 340/331 |

OTHER PUBLICATIONS

*Installation Instructions*, System Sensor, #I156–496–00, pp. 1–4, 1990.
*Wheelock*, pp. 1–6, 11–15.
*Amesco* Catalog, 1991.
FCI (3 pages).
Gentex catalog (4 pages).
*NFPA Journal*, Marketplace, p. 93, Nov./Dec. 1992.

*Primary Examiner*—Denise L. Gromada
*Assistant Examiner*—Thomas M. Sember
*Attorney, Agent, or Firm*—Dressler, Goldsmith, Shore & Milnamow, Ltd.

[57] ABSTRACT

A multiple element reflector usable with an elongated light source in a strobe unit provides wide fields of view in both horizontal and vertical directions when the unit is mounted on a wall. The reflector includes a first, elongated, curved reflector element which extends generally parallel to the elongated light source. At least second and third centrally located reflector elements extend between the first reflector element and the light source. The first reflector element provides illumination generally in horizontal and vertical directions perpendicular to the elongated source. The second and third centrally located reflector elements provide illumination in a direction generally along the elongated source.

5 Claims, 8 Drawing Sheets

44
56
54
40
46
52
42
22
32
30
20
30a
64a
64b
64c
64d
50
60
62

STROBE FOR DETECTOR

This application is a continuation, of application Ser. No. 08/065,624, filed May 21, 1993 U.S. Pat No. 5,448,462.

FIELD OF THE INVENTION

The invention pertains to output devices usable to provide a visible indication of an alarm condition. More particularly, the invention pertains to such devices which produce a high intensity light visible in both vertical and horizontal fields.

BACKGROUND OF THE INVENTION

There has been of late interest in alarm indicators which provide a visual indicium of an alarm condition. For example, it has been recognized that hearing impaired individuals may not hear a normal fire or smoke alarm. This is especially the case when such individuals are sleeping.

It has been known to couple high intensity strobe lights to alarm systems so as to provide a visual output. Known strobe units have not provided a satisfactory light output level over a 180 degrees horizontal field.

It would be desirable to be able to increase the output light level over a 180 degrees horizontal field of view without substantially increasing unit cost. In addition, it would be desirable to be able to manufacture the unit using conventional molding and finishing techniques.

SUMMARY OF THE INVENTION

A strobe in accordance with the present invention incorporates a multi-element reflector which can be supported in a housing. Some of the elements of the reflector correspond to partial parabolic surfaces.

Some of the surfaces extend axially and are contiguous to one another. Other surfaces protrude from the axially extending surfaces at angles on the order of 90 degrees and 45 degrees respectively.

An elongated cylindrical radiant energy source is carried extending co-extensively with the axially extending reflector surfaces. The source extends past the protruding reflector elements and is generally symmetrical with respect to the element extending on the order of 90 degrees from the axially oriented surfaces.

The plurality of axially extending, partial parabolic surfaces could be blended together to form a smooth, continuously changing surface.

DETAILED DESCRIPTION OF THE PREFERRED EMBODIMENT

Figure 1:
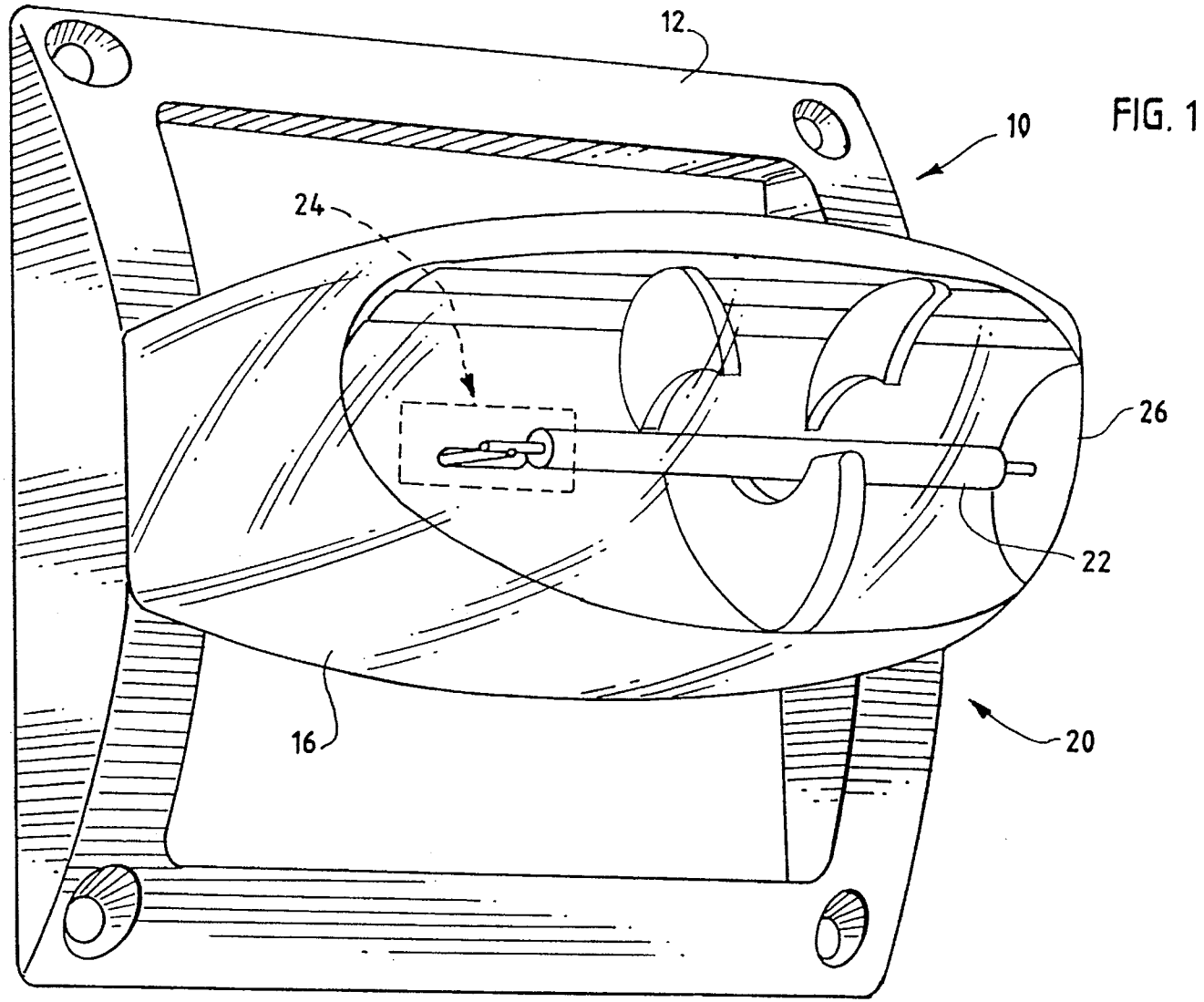
FIG. 1 is an overall view of a strobe in accordance with the present invention.
Figure 2:
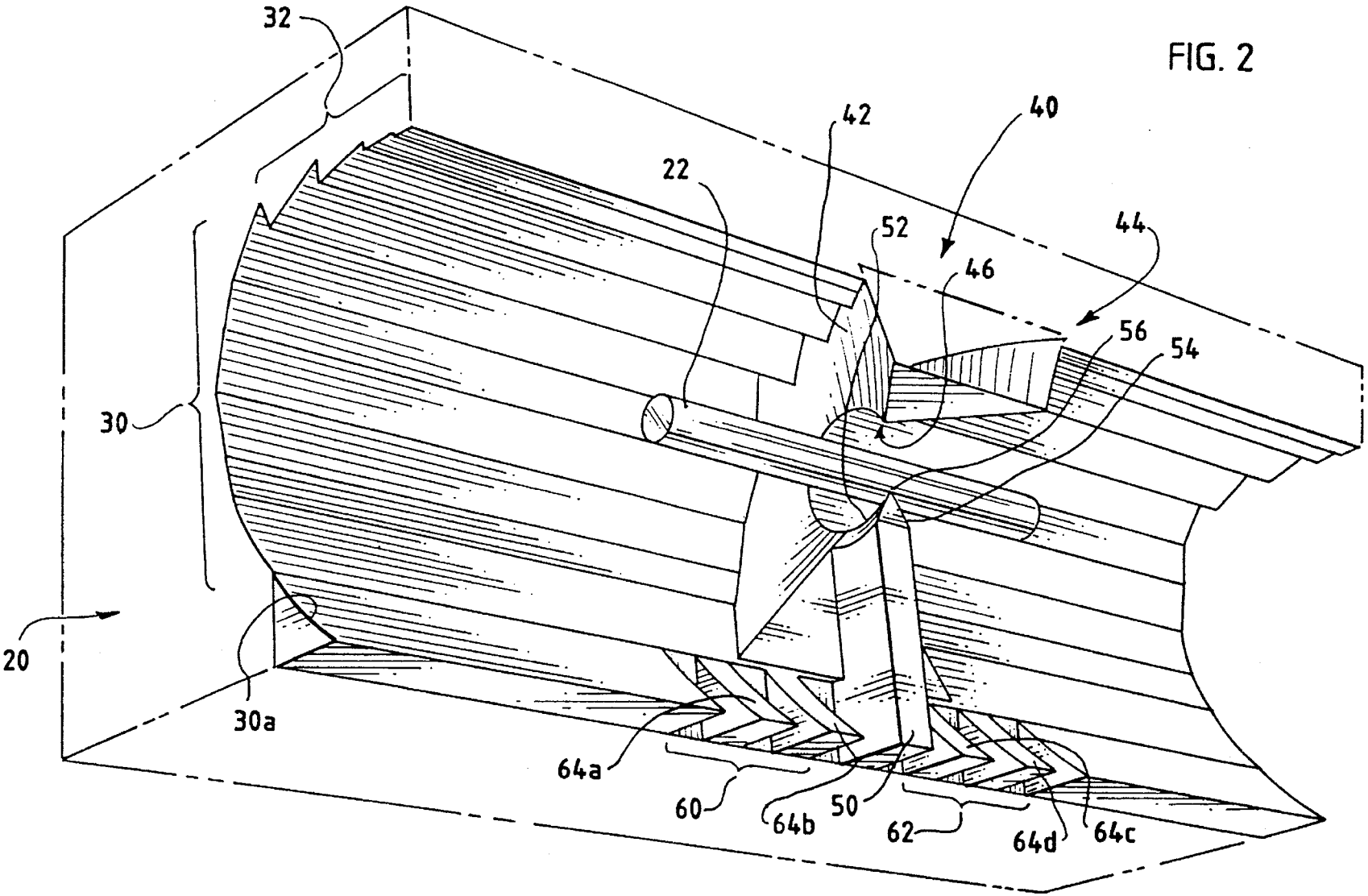
FIG. 2 is a perspective view illustrating the details of a particular embodiment of the reflector of the strobe of FIG. 1.
Figure 3:
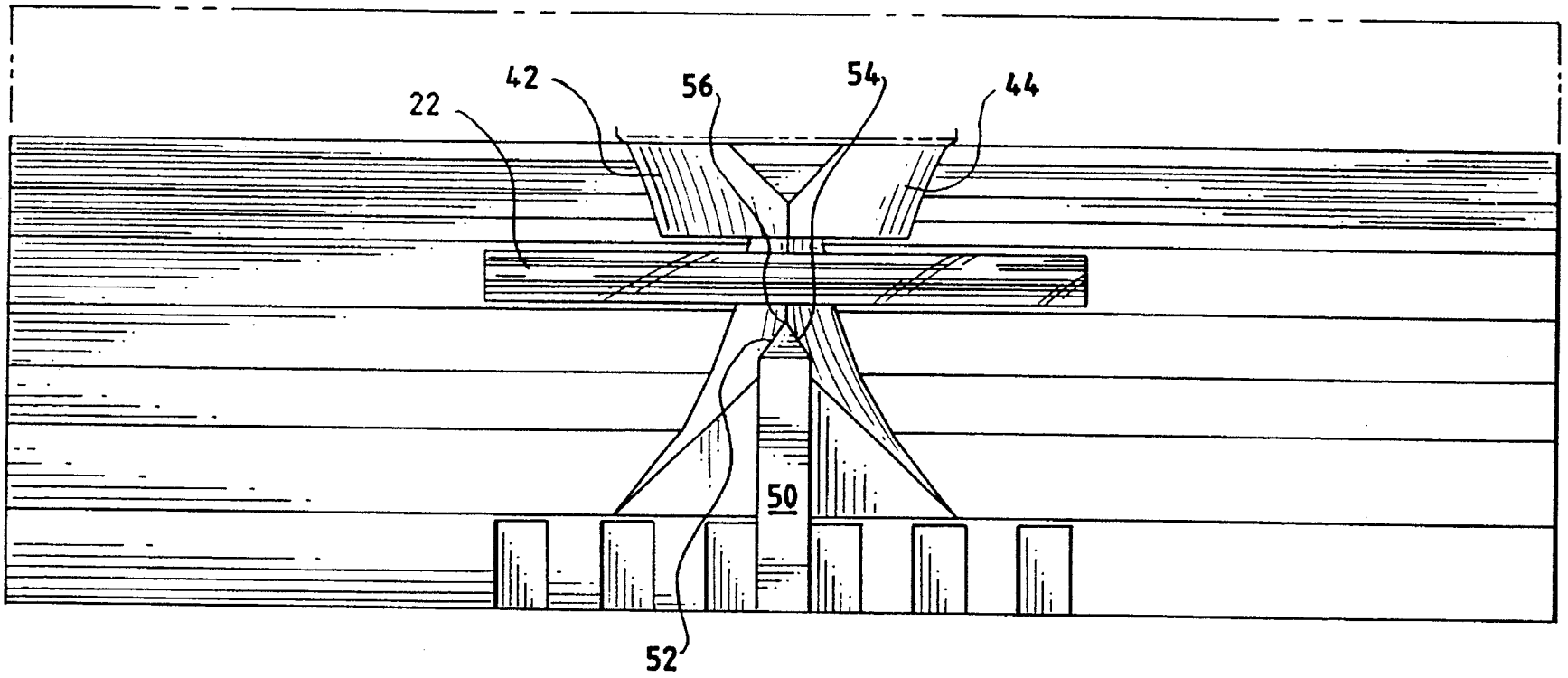
FIG. 3 is a front plan view of the reflector of FIG. 2.
Figure 4:
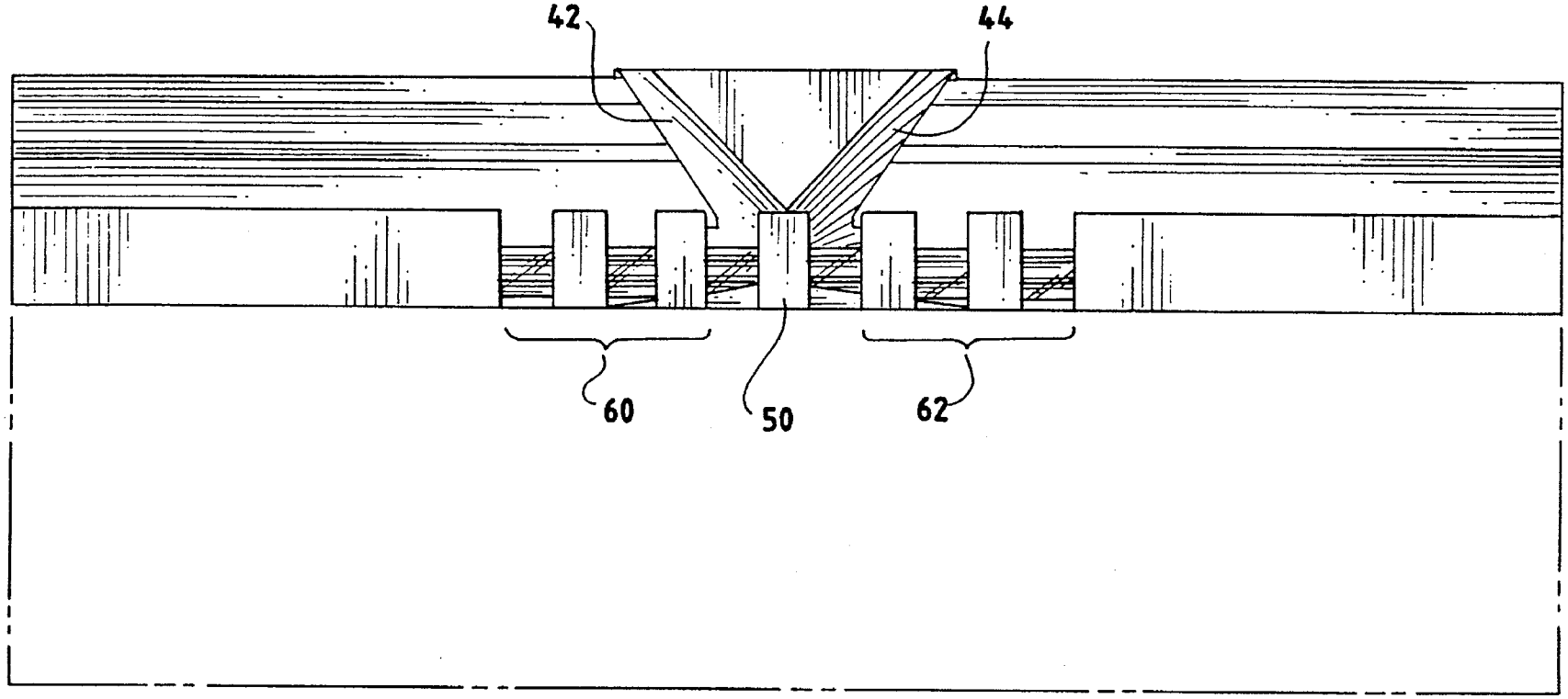
FIG. 4 is a bottom plan view of the reflector of FIG. 2.
Figure 5:
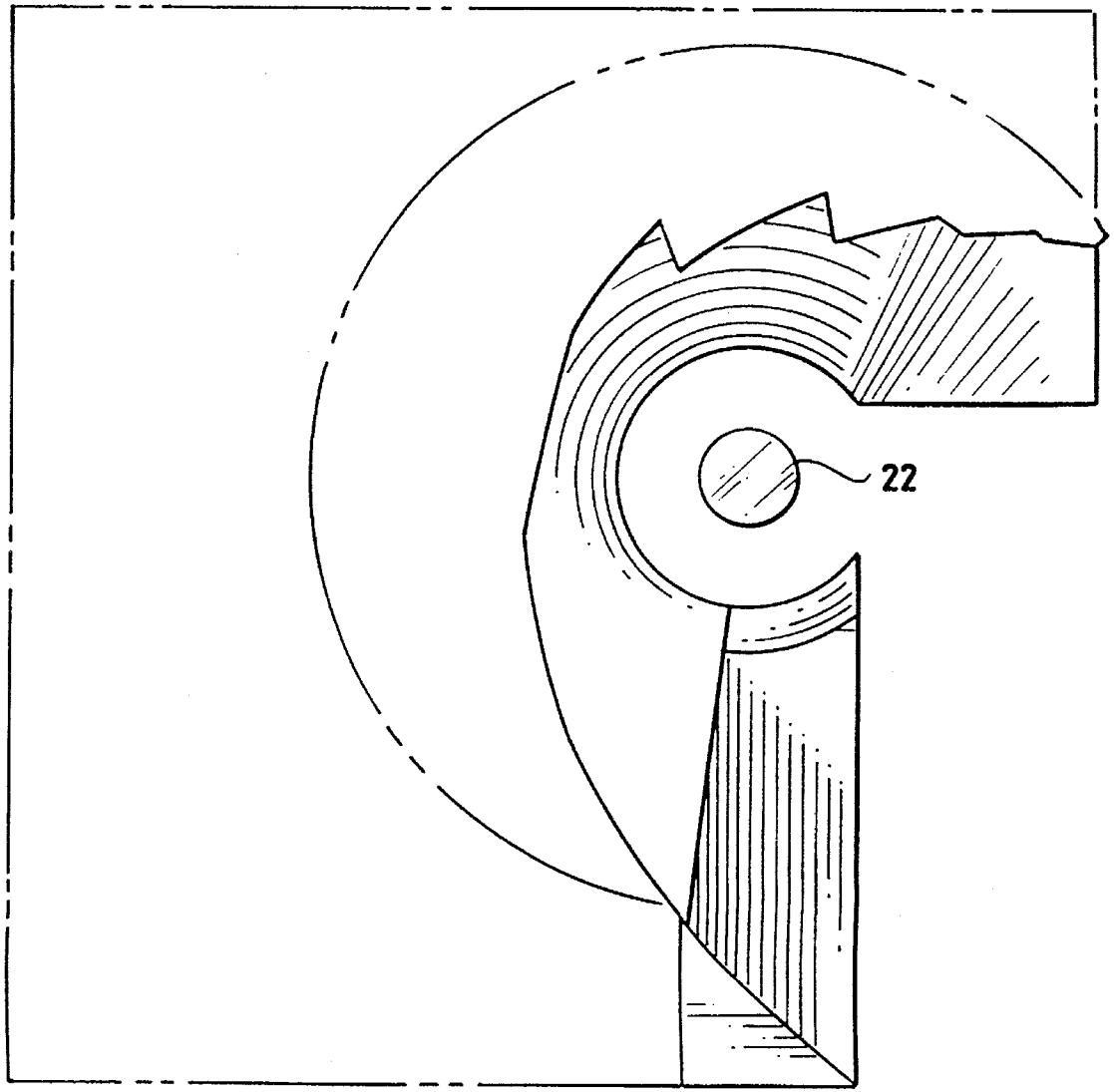
FIG. 5 is an end view of the reflector of FIG. 2.
Figure 6:
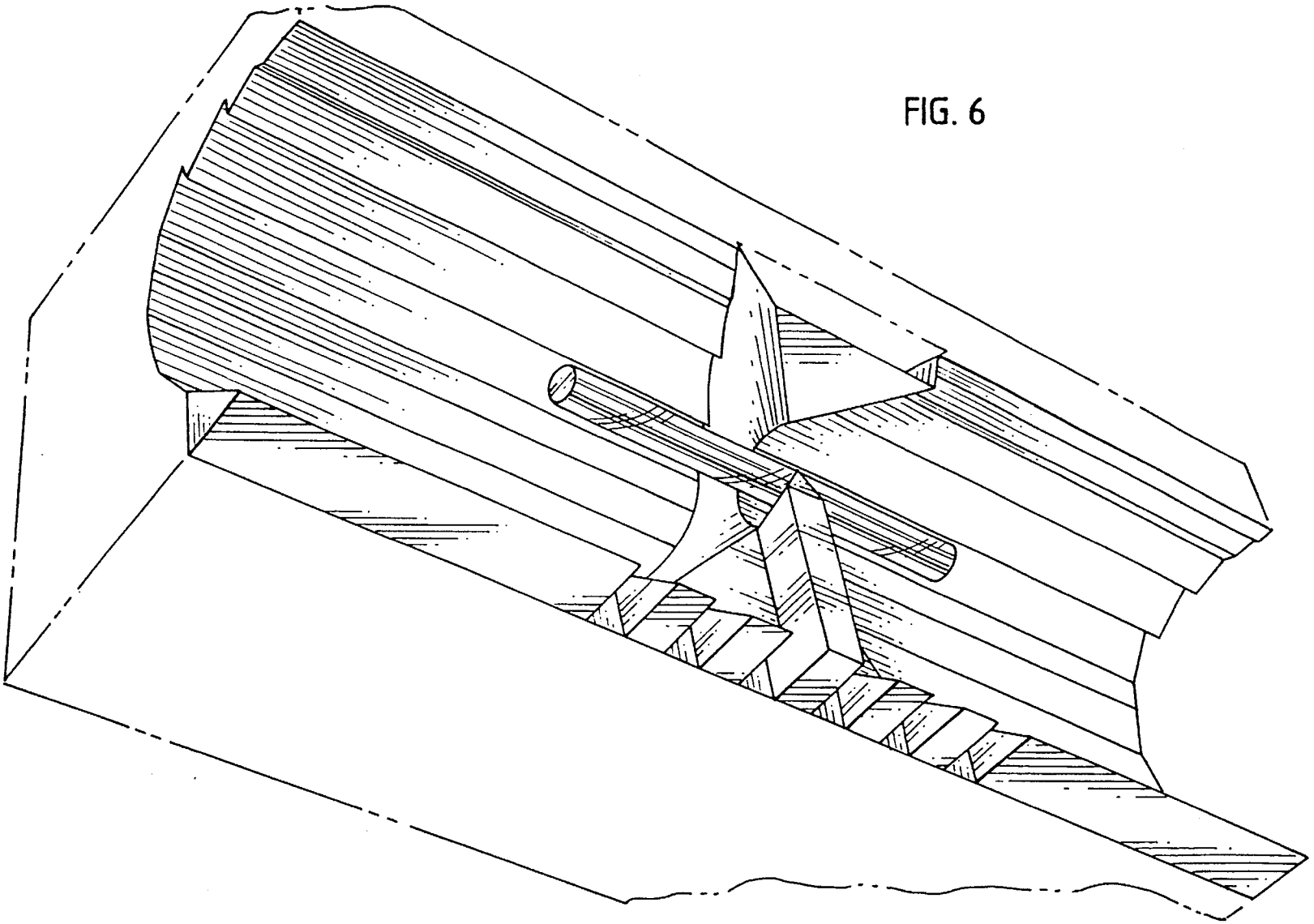
FIG. 6 is an alternate perspective view of the reflector of FIG. 1.

While this invention is susceptible of embodiment in many different forms, there is shown in the drawing and will be described herein in detail a specific embodiment thereof with the understanding that the present disclosure is to be considered as an exemplification of the principles of the invention and is not intended to limit the invention to the specific embodiment illustrated.

A strobe unit 10 in accordance with the present invention is illustrated in FIG. 1. The unit 10 includes a wall mountable base 12 to which is coupled a housing 16.

The housing 16 includes a multi-element reflector structure indicated generally at 20. Positioned within the reflector structure 20 is an elongated, linear and generally cylindrical source of radiant energy 22, such as a xenon flash tube.

It will be understood that the nature of the source 22 is not a limitation of the present invention. An electronic drive circuit 24, illustrated in phantom in FIG. 1, can be provided to drive the unit 10. A lens 26 covers the reflector and the source 22.

A preferred form of the reflector structure 20 is illustrated in FIGS. 2 through 6. The structure 20 includes a plurality of elongated, axially oriented elements generally indicated at 30 each of which forms a portion of a parabolic reflector. The members of a second contiguous group of axially extending elements, generally indicated at 32 are formed as a portion of an axially extending parabolic reflector.

The exact number Of members of the groups 30, 32 may vary and is not a limitation of the present invention. The members may all blend together to form a continuously varying reflective surface if desired without departing from the spirit and scope of the present invention.

Centrally located with respect to the elements 30, 32 is a multiple element central reflective region generally indicated at 40. The region 40 includes a first element which has first and second surfaces 42 and 44 which extend toward one another and meet at an apex region 46.

Offset from the surfaces 42, 44 is a reflector region 50 which extends substantially perpendicular to or normal to the axial elements 30, 32. The element 50 includes surfaces 52 and 54 which extend toward one another and meet in an apex region 56.

Adjacent to the region 56 are a plurality of slots generally indicated at 60, 62 formed in a lower, partial parabolic surface portion 30*a*. The slots 60, 62 function as light louvers to permit a portion of the light from the source 22 to exit vertically downwardly thereby providing vertical illumination immediately below the unit. Disposed between the slots 60, 62 are a plurality of spaced apart reflective surfaces such as 64*a* through 64*d* which deflect a portion of the light from the source 22 generally horizontally and in a direction normal to the unit.

Figure 7:
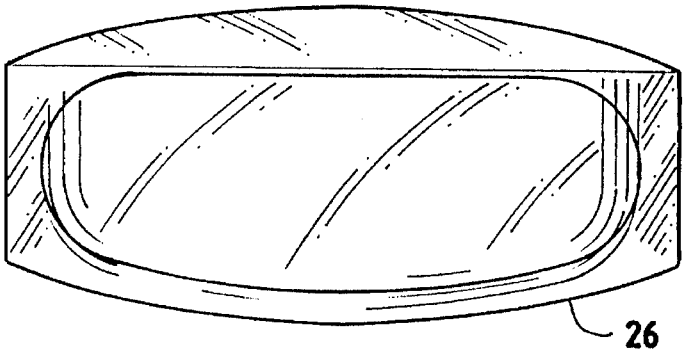
FIG. 7 is a front view of a lens usable with a reflector of FIG. 2.
Figure 8:
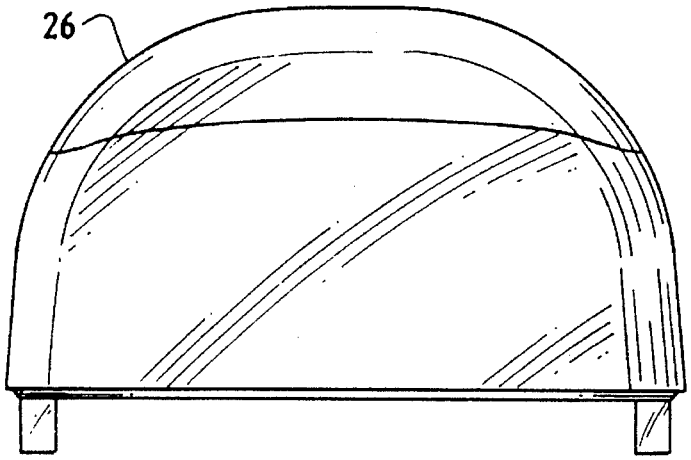
FIG. 8 is a bottom view of the lens of FIG. 7.
Figure 9:
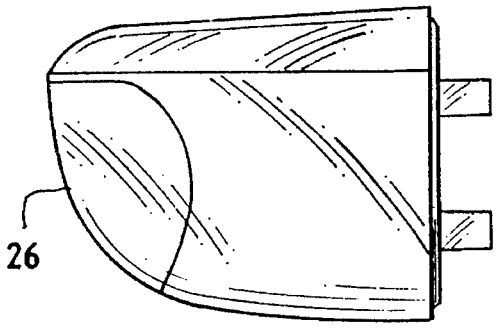
FIG. 9 is a right side view of the lens of FIG. 7; p
Figure 10:
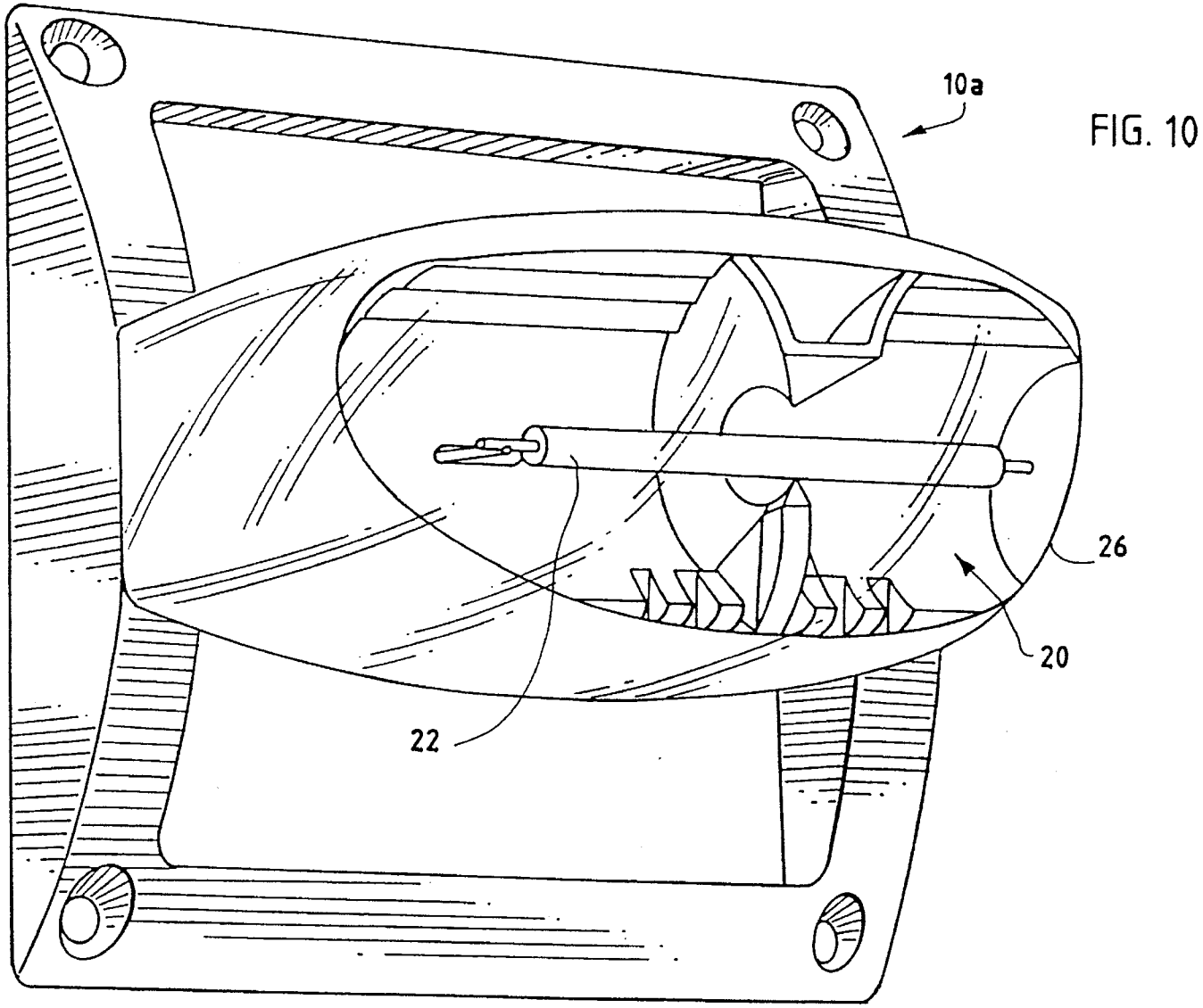
FIG. 10 is a perspective view of an alternate strobe unit in accordance with the present invention.

FIGS. 7 through 9 illustrate various views of a lens 26 for the unit 10. FIG. 10 is a preferred strobe unit 10*a* which illustrates details of the reflector 20. The unit 10*a* would be mounted on a wall at or above normal eye level. It provides a 180 degree horizontal illumination field and a 90 degree downward vertical illumination field from a center line of the source 22.

FIG. 10 is a perspective view illustrating details of the reflector 20 and the relationship thereof to the housing 16.

The unit 10 can be driven from a plurality of electrical circuits so as to provide a high intensity pulsed radiant energy output in both the horizontal and vertical viewing fields relative to the front of the unit. The structure of the drive circuits is not a limitation of the present invention.

What is claimed is:

1. A strobe unit energizable with electrical energy for illuminating a first field and a second field generally perpendicular to the first field, relative to a light source oriented parallel to the second field comprising:

a housing;

a concave multi-element reflector carried by said housing, said reflector defining an interior region and having first and second open ends, said concave reflector having at least one transverse reflecting member positioned within said interior region and generally transverse to said concave reflector; and an elongated high intensity source of visible radiant energy defining a longitudinal axis therethrough and disposed at least in part within said interior region, wherein said axis is generally transverse to said at least one transverse reflecting member, wherein at least a portion of said transverse reflecting member is positioned between said source and said concave reflector, and wherein radiant energy from said source in part impinges on said at least one transverse member and is reflected therefrom to, in part, illuminate a field which extends parallel to said longitudinal axis of said source, beyond said open ends of said concave reflector.

2. The strobe unit of claim 1 wherein said transverse reflecting member includes at least two reflecting surfaces, each of said reflecting surfaces generally unobstructedly reflecting energy from said source toward a respective open end of said concave reflector to illuminate a field which extends parallel to said longitudinal axis of said source, beyond said open ends of said concave reflector.

3. The strobe unit of claim 1 having a first, central transverse reflecting member positioned equidistant from each of said open ends, and second and third transverse reflecting members each being positioned between said central transverse member and a respective open end of said reflector.

4. A strobe unit energizable with electrical energy for illuminating a first field and a second field generally perpendicular to the first field, relative to a light source oriented parallel to the second field comprising:

a housing;

a concave multi-element reflector carried by said housing, said reflector defining an interior region and having first and second open ends, wherein said elements correspond to partial parabolic surfaces;

a transverse reflecting member positioned within said interior region and oriented generally transverse to said concave reflector, wherein said transverse member includes at least two reflecting surfaces in back to back relation one with the other; and an elongated high intensity source of visible radiant energy defining a longitudinal axis therethrough and disposed adjacent to some of said elements wherein said axis is generally transverse to said transverse reflecting member, wherein at least a portion of said transverse reflecting member is positioned between said source and said concave reflector, and wherein radiant energy from said source in part impinges on each of said back to back reflecting surfaces for generally unobstructedly reflecting energy from said source toward respective open ends of said concave reflector.

5. A multi-element reflector for use with a strobe unit energizable with electrical energy and having an elongated high intensity source of visible radiant energy for illuminating a first field and a second field generally perpendicular to the first field, relative to said source oriented parallel to the second field comprising:

a concave multi-element body defining an interior region and having first and second open ends, wherein said elements correspond to partial parabolic surfaces, and wherein said concave reflector includes at least one generally centrally located reflecting member positioned within said interior regions, transverse to said concave reflector, and wherein said radiant energy from said source in part impinges on said at least one centrally located reflecting member and is reflected therefrom and is visible from either of said first and second open ends.

* * * * *